United States Patent [19]

Hattori et al.

[11] 4,080,602

[45] Mar. 21, 1978

[54] WIRELESS CONTROL SYSTEM FOR A TRAVELLING TOY USING A SINGLE TRANSMITTING AND RECEIVING CHANNEL

[76] Inventors: Takeshi Hattori, No. 17-10, 5 chome, Nakagawa, Adachi, Tokyo; Zenichi Ishimoto, 3-753, Togasaki-cho, Misato, Saitama, both of Japan

[21] Appl. No.: 657,603

[22] Filed: Feb. 12, 1976

Related U.S. Application Data

[63] Continuation-in-part of Ser. No. 423,885, Dec. 12, 1973, abandoned.

[30] Foreign Application Priority Data

Jul. 4, 1973 Japan ..... 48-75553

[51] Int. Cl.[2] ..... H04B 7/00

[52] U.S. Cl. ..... 343/225; 46/219; 46/254; 46/262; 325/37

[58] Field of Search ..... 343/225; 46/219, 254, 46/262; 325/34, 37, 62, 66

[56] References Cited

U.S. PATENT DOCUMENTS

| | | | |
|---|---|---|---|
| 2,586,239 | 2/1952 | MacKenzie | 46/219 |
| 2,832,426 | 4/1958 | Seargeant | 325/37 |
| 3,116,454 | 12/1963 | Morris | 325/37 |
| 3,327,304 | 6/1967 | Willard | 325/37 |
| 3,454,927 | 7/1969 | Dame et al. | 343/225 |
| 3,720,281 | 3/1973 | Frownfelter | 343/225 |

*Primary Examiner*—Marshall M. Curtis

[57] ABSTRACT

This invention is concerned with a remote control trans-receiver system in which a transmitter having a single channel is used for transmitting information to a remote receiver adapted to receive the information for controlling the movements of a toy vehicle. The single transmitting channel includes means to provide modulated information onto a carrier wave for controlling the forward, rightward and leftward movements of the toy vehicle, and a switching device for preventing the transmission to the receiver of any modulating information to permit stopping of the forward movement of the vehicle and to enable, when desired, reverse movement of the toy vehicle. The receiver detects the modulated information, when present, for effecting forward, rightward or leftward movement of the toy vehicle. The receiver further includes a switching device which responds to the absence of a modulating signal on the carrier to stop and then reverse the direction of travel of the toy vehicle.

12 Claims, 8 Drawing Figures

WIRELESS CONTROL SYSTEM FOR A TRAVELLING TOY USING A SINGLE TRANSMITTING AND RECEIVING CHANNEL

RELATED APPLICATION

The present application is a Continuation-In-Part of Ser. No. 423,885 filed Dec. 12, 1973 entitled A WIRELESS CONTROL DEVICE FOR TRAVELLING TOY the disclosure of which is incorporated herein as if fully set forth.

BACKGROUND OF THE INVENTION

This invention is concerned with a remote control system and more particularly with a transmitting unit distant and separate from a receiver unit, the latter being carried by a device; e.g. a toy vehicle for control thereof by the transmitting unit. The invention also relates to a method in which a single transmitting frequency serves under specified conditions to control diverse movements of the movable device.

It is known from U.S. Pat. No. 3,720,281 to use high frequency carrier signals to control the movement of the rear wheels of a golf club carrier or golf cart. In the disclosed device, movement of the vehicle is under control of separate drive motors for the rear wheels as a function of signals received by a pair of antennae. The need for left and right antennae for this purpose complicates the system making it more costly and more likely to malfunction due to its increased complexity.

It is also known to control machinery from a remote location, as exemplified by the disclosure of U.S. Pat. No. 3,454,927. In particular, a transmitter is provided which generates a fixed sequence of tone groups, one of which is a low frequency tone and the other of which is a high frequency tone. One tone is for function control while the other determines the operation to be carried out by the function selected. The tones of the different frequencies are separated at the receiver unit. To discriminate between tones of different frequencies, a multiple channel receiver must be used which again adds to the complexity and cost of the device, both undesirable factors since toys to be marketable must be of simple design and low cost construction.

SUMMARY OF THE INVENTION

In the present invention which is directed to the remote control for a movable toy device, a transmitter is provided which generates and transmits a single high frequency signal, e.g., a signal whose frequency is exemplified as being 27.125 $MH_z$, to a remote receiver housed in a toy device. The receiver advantageously has a single receiving channel for controlling motor means which governs the front wheels of the toy device selectively to enable forward and reverse movements as well as stopping and turning of the toy device. The single high frequency signal is modulated in order to effect the forward and turning movements of the toy. Because only a single high frequency carrier need be generated and because the modulation of the carrier determines forward, left and right turn movements of the vehicle only a single receiving antenna need be used in conjunction with a single receiving channel which incorporates detector means for demodulating the received modulated carrier and band pass filters for passing the demodulated signal, as a function of the frequency of the demodulated signal, through a high pass and a low pass filter network, the relative outputs of which determine the direction of movement of the vehicle; e.g. when the outputs are equal the vehicle moves straight ahead and when unequal will turn as a function of the relative output levels, derived from the filter network, which when amplified energizes motors which turn the wheels of the vehicle.

It will be appreciated from the foregoing that among the many objects of the invention, one is to provide a radio control device which utilizes single transmitting and receiving channels for controlling movement of the toy vehicle.

Another object of the invention is to control movements of a toy vehicle as a function of a signal modulated on a single high frequency carrier, the frequency of the modulated signal determining the direction of movements of the vehicle.

With the foregoing in mind, we provide in accordance with the invention a system comprising a transmitting unit selectively to transmit an unmodulated or a modulated carrier of a predetermined frequency and a receiver unit for receiving, by means of a single antenna, the modulated or unmodulated carrier signal transmitted by the transmitting unit. The received signal, after detection and amplification, is fed to a low-pass filter network and a high-pass filter network which branch off in parallel from an amplitude limiter. The low-pass and high-pass filter outputs after rectification and amplification, if necessary, control energization of, for example, DC motors which drive the wheels of the vehicle.

For advancing, stopping and backing up of the toy, a switch provided in the transmitting unit is opened, whereby to transmit an unmodulated carrier signal which when received by the receiver operates, as hereinafter more fully described, a rotary relay or servo motor is actuated stepwise, to stop, reverse or advance the vehicle as schematically shown in FIG. 6.

Other objects and advantages of the invention will become obvious after considering the detailed discussion of the invention in connection with the preferred embodiments thereof shown in the accompanying drawings.

DESCRIPTION OF THE PREFERRED EMBODIMENTS

Figure 1:
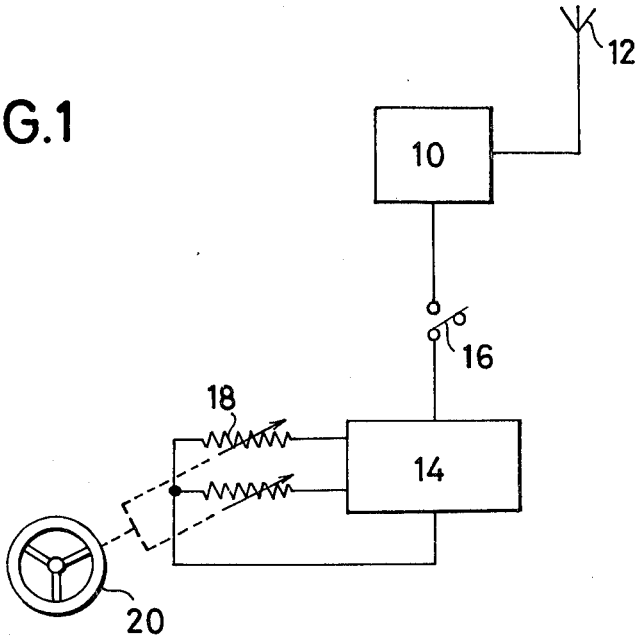
FIG. 1 is a schematic representation of a transmitter in accordance with the invention.

Referring now more particularly to FIG. 1 of the accompanying drawings, which shows the transmitter unit in accordance with the present invention, there is illustrated a remote control signal information transmitting unit which comprises a high frequency oscillator 10 which generates a carrier of high frequency for transmission by transmitting antenna 12. For modulating the carrier there is provided a low frequency generator 14 which may take the form of a variable frequency multivibrator the frequency of which may be determined by positioning the variable arms of parallel connected resistors 18 under control of handle 20. Switch 16, located between multivibrator 14 and oscillator 10, when closed permits modulation of the carrier with the multivibrator output at the multivibrator frequency and when opened isolates the multivibrator output from the carrier signal so that an unmodulated carrier is transmitted from the transmitter unit by antenna 12.

The oscillator 10 preferably generates a high frequency signal of predetermined frequency, for example, 27.125MH$_z$. As will be seen, only two controls are required in the transmitting unit of FIG. 1, namely switch 16 and handle 20 affording thereby simple operation of the vehicle. It will be appreciated that when switch 16 is open, the handle 20 does not permit any control function. The multivibrator 14 for purpose of disclosure may generate a signal having a frequency ranging from 200 to 2,000 H$_z$.

Figure 2:
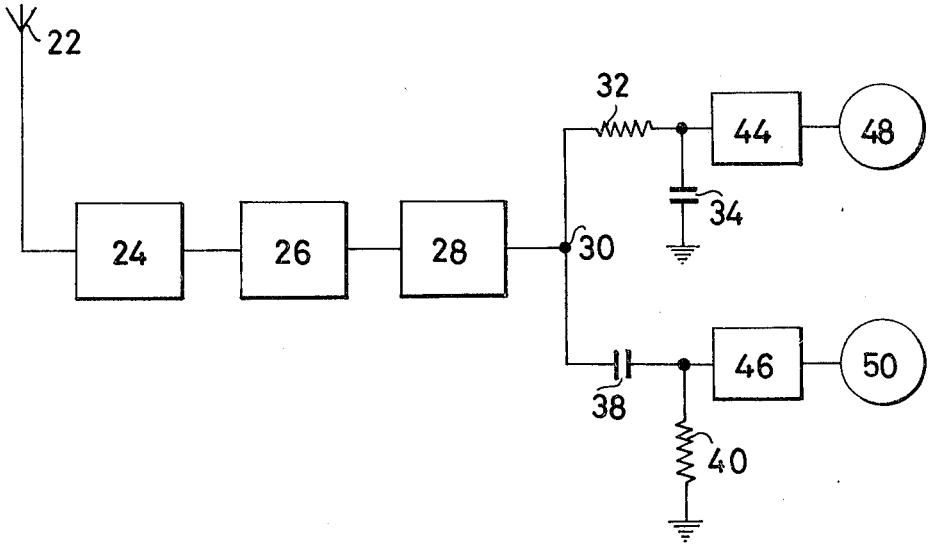
FIG. 2 is a block diagram of a remote receiver in accordance with a first embodiment of the invention and adapted to receive signals from the transmitter of FIG. 1.

Referring to FIG. 2, there is shown a receiving unit adapted to receive the modulated or unmodulated signals transmitted thereto by the transmitter of FIG. 1 for controlling movement or stopping of the toy vehicle, i.e. forward, reverse, right or left steering movements and stopping.

Antenna 22 receives the transmitted signal and supplies it to a super regenerative detector 24 which may be either a frequency discriminator, if a frequency modulated signal is transmitted from the receiver unit, or an amplitude demodulator, if an amplitude modulated signal is transmitted thereby. Connected in series with detector 24 is a low frequency amplifier 26 for amplifying the demodulated signal and an oscillation amplitude limiter 28 which limits the amplitude of the output of the amplifier 26.

Figure 3:
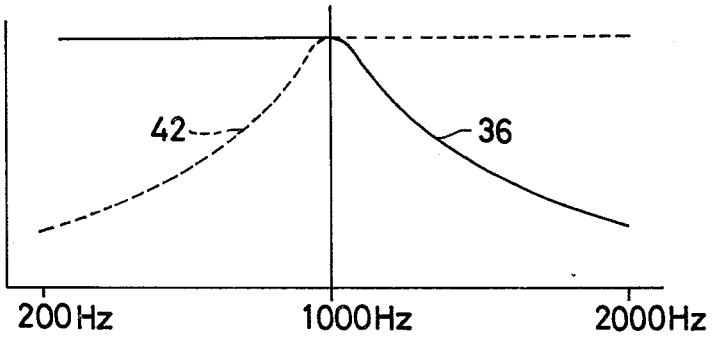
FIG. 3, is a diagrammatic view of a graphical representation of a frequency-gain curve for use in explaining the principles of the invention.

As noted heretofore, vibrator 14 generates low frequency signals in the range of, for example, 200 to 2,000 H$_z$. When a carrier signal is modulated at a selected frequency of the multivibrator and transmitted for reception by the receiver and demodulated therein for recovery of the modulating signal, the latter is applied as an output from the amplitude limiter 28 to a point 30 from which branches a low frequency band-pass filter constituting resistor 32 and condenser 34, and a high frequency band pass filter constituting condenser 38 and resistor 40. These band-pass filters are designed to provide the gain characteristics shown in FIG. 3. Thus, as will be seen in this Figure the output of the low-pass filter for signals between 200 to 1000 H$_z$ will be of uniform high value (solid line) but will progressively decrease, as shown by solid line 36 at frequencies from above 1,000 H$_z$ to 2,000 H$_z$. Conversely, the high band-pass filter will have a uniform high output at frequencies from above 1,000 to 2,000 H$_z$ (dotted line) and the output will progressively decrease, as shown by dotted line 42, at frequencies from below 1,000 to 2,000 H$_z$. It will also be seen from FIG. 3 that at 1,000 H$_z$ the outputs from the low and high band-pass filters are equal. Accordingly, when the demodulated signal at the output of detector 24 is a 1,000 H$_z$ signal the outputs from the low frequency band-pass and high frequency band-pass filters will be equal. In this case, the wheels of the toy will be driven by the motors at the same speed so that the vehicle will move in a straight path. If the demodulated signal is a 200 H$_z$ signal the output from the low frequency band-pass filter will be greater than the output from the high frequency band-pass filter. Conversely, if a 2,000 H$_z$ demodulated signal is passed through the filters the output from the high frequency band-pass filter will be greater than the output from the low frequency band-pass filters. The reduced outputs of the one or the other filter network operates to dampen that motor supplied with the lower output voltage. For this purpose, the output of, for example, the low frequency band-pass filter is connected to a voltage rectifying-amplifier 44 which in turn is connected with DC motor 48 to drive a wheel 68 (FIG. 7) or ceterpillar tread 76 (FIG. 8). The output of the high frequency band-pass filter on the other hand is connected with a voltage rectifying-amplifier 46 which supplies a DC voltage to DC motor 50 to drive the wheel 70 (FIG. 7) or caterpillar tread 78 (FIG. 8). It will be apparent that when the high frequency carrier is modulated at a frequency other than the exemplified 1,000 H$_z$, the vehicle will be turned from its straight path movement due to the greater damping action on one of the motors than the other.

Figure 4:
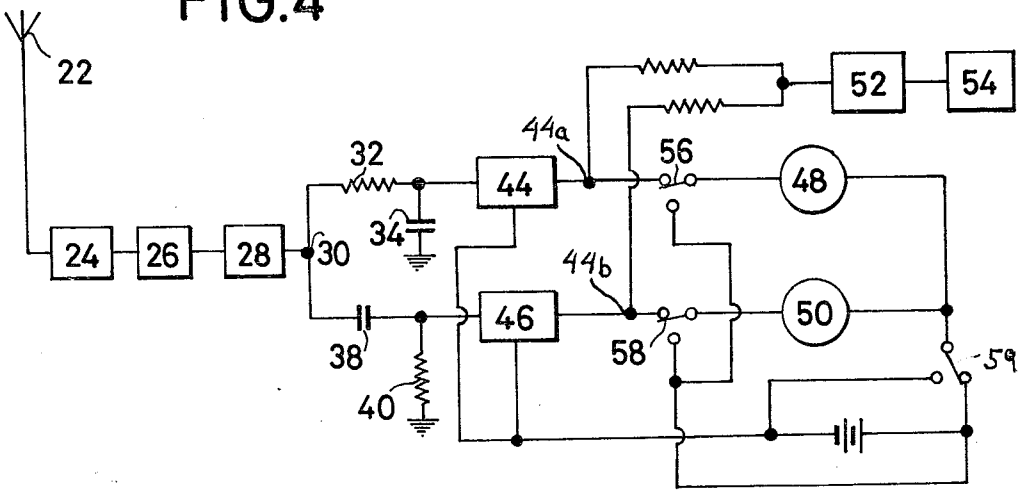
FIG. 4 is a block diagram of another remote receiver in accordance with a second embodiment of the invention, which receiver is also adapted to receive signals from the remote transmitter of FIG. 1.
Figure 5:
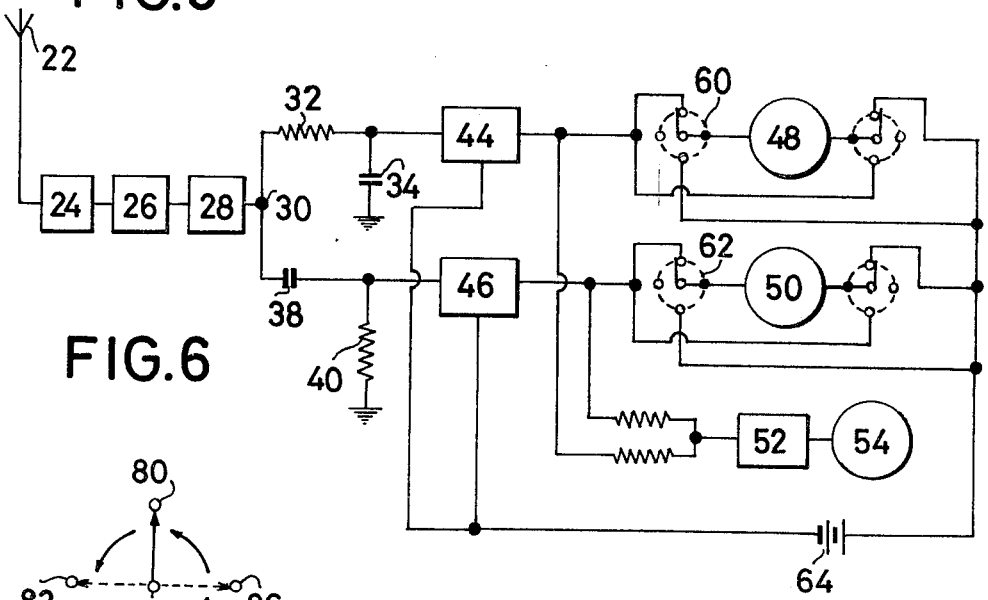
FIG. 5 is a block diagram of another remote receiver in accordance with a third embodiment of the invention, which is also adapted to receive signals from the remote transmitter of FIG. 1.
Figure 6:
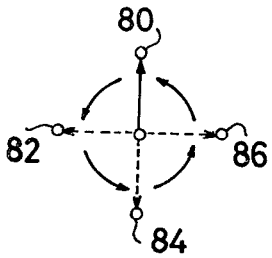
FIG. 6 is a schematic view of a rotary switch for use in the embodiment of FIG. 5.

Referring now to FIG. 4 which shows another embodiment of a single channel receiving unit in accordance with the invention, in which the same components are identified with the same reference numerals, there is shown additional circuitry interposed between elements 44 and 48 on the one hand and elements 46 and 50 on the other hand. The additional circuitry is intended to permit stopping and reversal of operation of motors 48 and 50 to in turn stop and reverse rotation of the vehicle drive wheels or caterpillar tread 70. To this end amplifer 52 and a rotary relay or servo motor 54 are shown electrically connected by means of resistors to junctions **44*a* and 44*b*. Between junction 44*a* and motor 48 is connected switch 56 and between junction 44*b* and motor 50 is connected switch 58. These switches together with switch 59, connected to voltage source 64, are operated by rotary relay 54 in such manner tha when an output voltage appears at junctions 44*a* and 44*b*, as would occur when a modulated carrier is received at the receiver, the amplifier 52 is rendered inoperative. Rotary relay 54 is of the type which responds to changes in state of amplifier 52 to actuate for each change of state switches 56, 58 and 59. With switches 56, 58 and 59 positioned as shown in FIG. 4, the wheels of the vehicle will be driven by the voltage source 64 as modified by the voltage outputs derived from the low and high frequency band-pass filters. If switch 16 in the transmitter unit is opened an unmodulated carrier is transmitted by antenna 12 and received by the receiver unit. Receipt of an unmodulated wave by receiver unit will fail to produce a voltage at junctions 44*a* and 44*b* in which circumstance the operational state of the amplifier 52 is changed and becomes operative at which time rotary relay 54 moves the movable arms of each of switches 56, 58 and 59 into engagement with the free contact of these switches to reverse operation of motors 48 and 50. If desired, switches 56, 58 and 59 may be replaced by rotary switches 60, 62 as shown in FIG. 5 which are operated by rotary relay 54 connected in circuit with amplifier 52 in the same manner as in the described circuit arrangement of FIG. 4. By using rotary switches 60, 62 the vehicle can be advanced, stopped, reversed and again stopped as shown in FIG. 6, the precise order of course being subject to change according to the intended purpose. As in FIG. 4, the motors are energized by voltage source 64** damped by the output of the low and high frequency band-pass filters when a modulated carrier is received.

Figure 7:
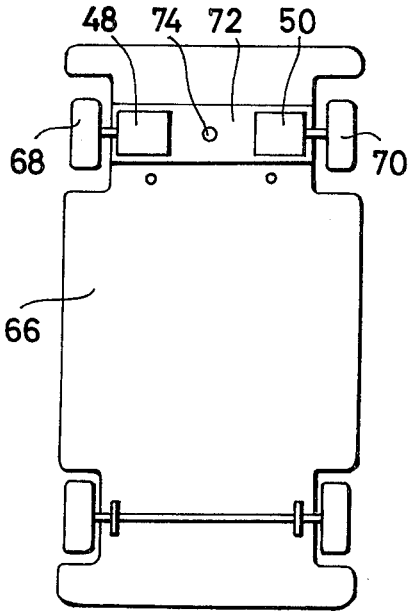
FIG. 7 is a plan view of a movable device, and in particular, a toy with pairs of forward and rearward wheels.
Figure 8:
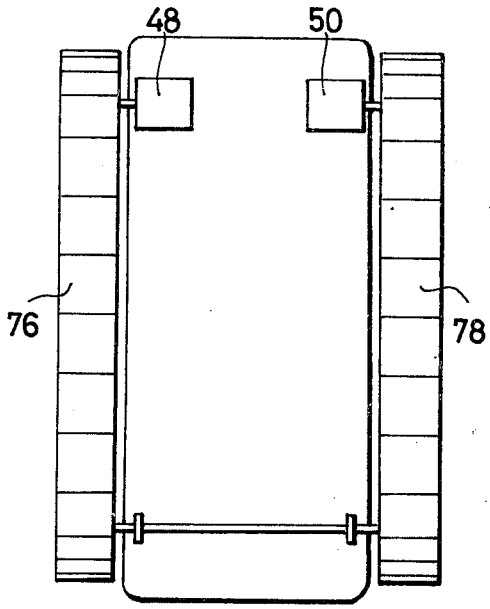
FIG. 8 is a plan view of another movable device adapted to carry the remote receiver, and in particular, a toy with caterpiller-type treads for movement of the toy.

FIG. 7 illustrates a travelling toy 66 provided at its front left side with the wheel 68 and at its front right side with the wheel 70 respectively driven by the motors 48 and 50 supported by a plate 72 which is pivotally mounted to a toy body 66 through a pivot 74. When there is a difference in the r.p.m. of the driven wheels 68 and 70, the vehicle will turn from a straight course. FIG. 8 shows a further embodiment of the toy, the advancing direction of which may be altered by merely varying the driving speed of the catapillar treads 76 and 78 as a function of the modulating frequency of the carrier.

In the operation of the wireless control device according to the invention, a high frequency signal is generated by the high frequency oscillator 10. The high frequency may selectively be modulated by the multivibrator 14 at a frequency determined by the setting of resistors 18 by handle 20. The thus modulated high frequency signal when transmitted by the antenna 12, is received by the antenna 22 and detected by the super regenerative detector 24 the output of which is amplified by the low frequency amplifier 26. The output of amplifier 26 is supplied to the amplitude limiter 28, the output of which is simultaneously fed to the low-pass and the high-pass filters. For band-pass filters having the characteristics shown in FIG. 3, if a 1,000 $H_z$ demodulated signal is simultaneously fed to the band-pass filter networks of FIGS. 4 and 5, the output of each filter network will be substantially the same so that substantially the same damping factor is obtained in consequence of which motors 48 and 50 will drive wheels 68 and 70 at substantially the same r.p.m. whereby to advance the toy in a straight line.

Should the variable resistor 18 be adjusted by handle 20 at the transmitter to vary so that the frequency of the multivibrator 14 is lowered below the 1,000 $H_z$ value, the signal passing through the low-pass filter will be dampened to a lesser degree than the signal which passes through the high-pass filter. In consequence, motor 48 will rotate at a higher r.p.m. than motor 50 so that the vehicle will now turn from its straight line movement as a function of the relative damping factors of the low and high band-pass filters. On the other hand, when the detected frequency from multivibrator 14 is higher than the exemplified 1,000 $H_z$, the signal through the high-pass filter sustains a lower damping factor than it sustains in passing through the low pass filter so that motor 48 is rotated at a lower r.p.m. than motor 50 in consequence of which the vehicle is now moved from its straight line path (which it assumes at 1,000 $H_z$) to a direction opposite to that driven when the modulating frequency is below 1,000 $H_z$.

When the switch 16 is opened an unmodulted carrier is transmitted and received by the receiver. Accordingly, on receipt of the unmodulated signal there will be no output from detector 24, amplifier 26 or amplitude limiter 28. Amplifier 52 is designed to be operative in the absence of an input signal from the band-pass filters and to be inoperative in the presence of such signal, the latter signal being developed only on receipt of the modulated carrier. Rotary relay 54 is operated, in known manner, to advance one step at a time for each change of state of amplifier 52; i.e. conductive to non-conductive state and vice-versa. Since the operating state of amplifier 52 is effectively controlled by switch 16 it will be appreciated that the relay 54 will be advanced one step at a time each time switch 16 is moved from its closed to its open position and vice versa. Switches 60 and 62 associated with relay 54 are thus rotated and advanced one step at a time under control of relay 54. Accordingly, rotary switches 60 to 62 may be advanced first to position 80 then to the stop position 82, then to the reverse position 84 and again to the stopping position 86, all as shown in FIG. 6, the continuous operation of switches 60 and 62 to these sequential positions being carried out under control of switch 16.

As will now be appreciated, the objective of providing a low cost simple to operate remote control toy is fulfilled by the invention in requiring but a single channel receiver and transmitter the carrier of which, when modulated at predetermined frequencies, permits straight and turning movement of the toy vehicle and also enables stopping and reverse movement of the vehicle by the simple expedient of operating an on-off switch in the transmitting unit.

What is claimed is:

1. A wireless control system for controlling direction and movement of a movable toy vehicle having at least two drivable wheels driven each by its own motor energized by a source of energy, comprising a transmitting unit for transmitting a single high frequency signal and a receiving unit remote from said transmitting unit housed by said movable vehicle and responsive to said high frequency signal for controlling movement of said wheels, said transmitting unit comprising means for producing and transmitting a single carrier frequency, generating means for generating a modulating wave of a selected frequency within a predetermined frequency range, said generating means including means for selecting any modulating frequency within said range and switch means interposed between said carrier frequency providing and transmitting means and said modulating wave generating means for selectively modulating or refraining from modulating said carrier frequency as a function of position of said switch means, said receiving unit including means operatively connected to respective ones of said motors and responsive on the one hand to the frequency of a modulated carrier signal received by the receiver unit and on the other hand to an unmodulated carrier signal received by the receiver for respectively controlling energization of the motors to effect forward and turning movements on the one hand and stopping and reverse movements on the other hand.

2. A system according to claim 1, wherein said receiver means includes detector means for demodulating said modulated carrier signal and for recovering a demodulated signal carrier signal, a low frequency amplifier and amplitude limiter connected in series with and supplied with the output of the low frequency amplifier, a low frequency band-pass filter interposed between said source of energy and one of the motors and coupled to the output of said amplitude limiter to readily pass frequencies of said demodulated carrier signal below a predtermined frequency, a high frequency band-pass filter interposed between the source of energy and the other of said motors and connected to the output of said amplitude limiter to readily pass frequencies higher than said predetermined frequency, and amplifier means connected to the outputs of each of said low and said high frequency band-pass filters for supplying energizing current to said motors as a function of the frequency of the signal demodulated by said detector means.

3. A system as claimed in claim 2, including a further amplifier coupled in circuit with said low and said high frequency band-pass filters and said motors and being operative in response to receipt of an unmodulated signal to reverse the direction of rotation of said motors and thereby said wheels.

4. A system as claimed in claim 3, including a servo motor in series connection with said further amplifier, and further switch means interposed between said amplitude limiter and said motors and operated by said servo motor.

5. A system as claimed in claim 3, including a rotary relay in series connection with said further amplifier for operation thereby, and a rotary stepping switch having four stepping positions interposed between said motors and said amplitude limiter for sequentially stopping, forward, stopping and reverse movements of the movable vehicle in response to operation of said rotary relay as a function of operation of said first-named switch means in said transmitting unit.

6. A wireless control system for controlling direction of movement of a vehicle having at least two wheels driven by motors energized by a source of energy, comprising a transmitting unit having a single channel oscillator for generating a single high frequency signal and means for selectively modulating or preventing modulation of the high frequency signal, said system including a receiving unit having a detector for demodulating the transmitted signal, if modulated, for recovering a signal of the same frequency as the carrier modulating signal, a low frequency amplifier to which said recovered signal is supplied for amplification thereby, an amplitude limiter supplied with the output of said amplifier, a low frequency band-pass filter supplied with the output of said limiter and interposed between the source of current and one of said motors, a high frequency band-pass filter also supplied with the output of the limiter and also interposed between the source of current and the other of said motors, said low and high frequency band-pass filters differentially damping the output of said amplitude limiter as a function of the frequency of the signal recovered by said detector above and below a predetermined frequency to thereby alter the r.p.m. of the motors as a function of the damping factor.

7. The control system according to claim 6, including stepping switch means connected in circuit between said high and low frequency band-pass filters and said motors, and actuating means effective to operate said stepping switch means in the absence of receipt at said receiver of a modulated signal.

8. The control system according to claim 7, wherein said actuating means comprises a rotary relay.

9. The control system according to claim 7, wherein said actuating means comprises a servo motor.

10. The control system according to claim 6, wherein said motors are reversible, said system including selectively operable polarity reversing switch means interposed between each of said high and low frequency band-pass filters and their associated motors.

11. The method of controlling the movement of a movable vehicle having at least two wheels driven by reversible motors energized by a source of current, comprising generating a single channel high frequency carrier signal, selectively modulating or not the high frequency carrier signal at a modulation frequency within a predetermined range, transmitting the high frequency carrier signal thus produced, receiving said signal, detecting the modulation component on the carrier, if modulated, to recover the modulating component, passing the modulating component simultaneously to a high frequency band-pass filter and a low frequency band-pass filter electrically connected to the source of current, amplifying the signals from said high and low frequency band-pass filters, and supplying the thus amplified signals respectively to said motors to damp the operation of said motors as a function of the frequency of the modulating component passed by said low and high frequency band-pass filters.

12. The method according to claim 11, including the step of stopping said movable vehicle by deenergizing the motors by means of rotary switches operated by a rotary relay energized by amplifier means electrically connected to the band-pass filters when the output from the latter is zero.

* * * * *